United States Patent [19]

Gomes et al.

[11] Patent Number: 4,941,634

[45] Date of Patent: Jul. 17, 1990

[54] MOUNTING APPARATUS FOR EYEGLASSES

[75] Inventors: Gary D. Gomes, Alameda County; Craig M. Gomes, San Mateo County; Frank M. Figone, San Mateo County; Moira J. Figone, San Mateo County, all of Calif.

[73] Assignee: GFS, Inc., San Mateo, Calif.

[21] Appl. No.: 295,814

[22] Filed: Jan. 9, 1989

[51] Int. Cl.[5] ..... A47B 96/00

[52] U.S. Cl. ..... 248/229; 248/231.8; 248/316.7; 248/902

[58] Field of Search ..... 248/DIG. 2, 316.7, 229, 248/231.8; 211/13

[56] References Cited

U.S. PATENT DOCUMENTS

| | | | |
|---|---|---|---|
| 2,467,251 | 4/1949 | Bowman | 248/DIG. 2 X |
| 2,958,495 | 11/1960 | Foster | 248/DIG. 2 X |
| 3,228,640 | 1/1966 | Wolsh | 248/229 X |
| 3,259,348 | 7/1966 | Dann | 248/DIG. 2 X |
| 3,291,429 | 12/1966 | Neanhouse | 248/DIG. 2 X |
| 3,836,106 | 9/1974 | Gray | 248/229 |
| 4,558,788 | 12/1985 | Grothaus | 248/DIG. 2 X |
| 4,702,451 | 10/1987 | Salazar, Jr. et al. | 248/DIG. 2 X |

FOREIGN PATENT DOCUMENTS

| | | | |
|---|---|---|---|
| 1236766 | 6/1960 | France | 248/316.7 |
| 2422216 | 12/1979 | France | 248/DIG. 2 X |
| 415105 | 12/1966 | Switzerland | 248/DIG. 2 X |
| 1188448 | 4/1970 | United Kingdom | 248/DIG. 2 X |

*Primary Examiner*—David L. Talbott

*Attorney, Agent, or Firm*—Flehr, Hohbach, Test, Albritton & Herbert

[57] ABSTRACT

Apparatus for mounting eyeglasses to an object, the apparatus having a shaped body including a slot defined by at least one composite resilient finger, the finger and body including a U-shaped spring means embedded within the body and finger and surrounding the slot to resiliently bias the finger to a position closely proximate the body. The slot receiving and holding eyeglass bridges of different sizes. The finger and body are formed of a material which is soft and compliant relative to plastic eyeglass materials to resist scratching eyeglasses. A jaw is also provided for securing the body to an object.

5 Claims, 2 Drawing Sheets

MOUNTING APPARATUS FOR EYEGLASSES

BRIEF DESCRIPTION OF THE INVENTION

This invention relates to an apparatus for securely mounting eyeglasses. More particularly, it relates to a secure decorative eyeglass mounting apparatus in the form of a nose which can be attached to an object for mounting the eyeglasses on the object and thereby facilitate convenient and instantaneous mounting and retrieval of eyeglasses.

BACKGROUND OF THE INVENTION

Since eyeglasses are commonly misplaced, those who wear them, whether for vision enhancement or blocking sunlight, are repeatedly forced to search for those eyeglasses at particularly inconvenient moments. For example, when driving a car, a change of direction may result in the driver facing the sun. In such a situation, the driver will want to conveniently locate and secure sunglasses while keeping a hand on the driver's wheel and his or her eyes on the road. Similarly, if one is driving or sailing a boat, one would like to secure one's eyeglasses conveniently while keeping one's eyes on the water.

In either context, the person is forced to divert attention from the task at hand and search for the eyeglasses. The search is inconvenient, if not dangerous. Furthermore, if and when found, the eyeglasses are commonly in a position which allows them to be scratched or otherwise damaged.

OBJECTS AND SUMMARY OF THE INVENTION

It is an object of this invention to provide an apparatus which will enable one to easily store and conveniently locate eyeglasses.

It is another object of this invention to provide a mounting apparatus which will securely hold eyeglasses without scratching the lenses while also allowing convenient removal of eyeglasses from the apparatus.

Another object of this invention is to provide a decorative apparatus for mounting eyeglasses.

It is still another object of the invention to provide a secure means of holding eyeglasses, even when subjected to vibration, centrifugal force, and/or an inclined orientation with respect to the earth's gravity.

These and other objects are achieved by a shaped body including a pair of compliant fingers extending from the top of said body forming a slot suitable for receiving the bridge of eyeglasses and a jaw formed in the lower portion of said body wherein the jaw provides means to secure the body to an object.

BRIEF DESCRIPTION OF THE DRAWINGS

The invention will be more clearly understood from the following description read in connection with the accompanying drawings of which.

DETAILED DESCRIPTION OF THE INVENTION

Figure 1:
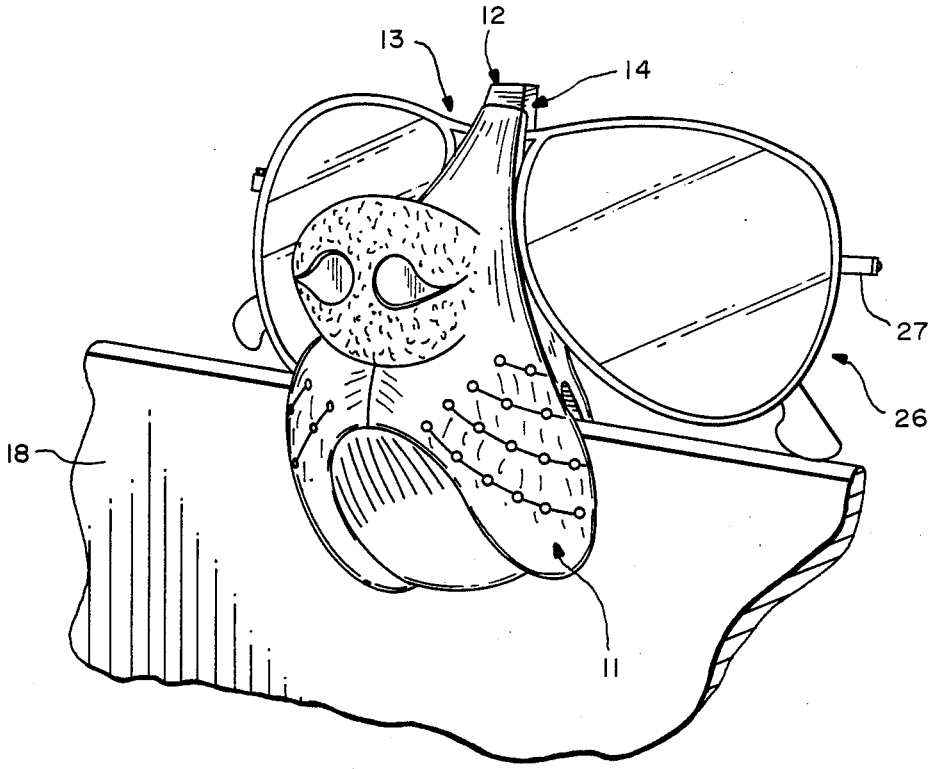
FIG. 1 is a perspective view of the mounting apparatus in accordance with this invention, with mounted eyeglasses, attached to a sun visor.
Figure 2:
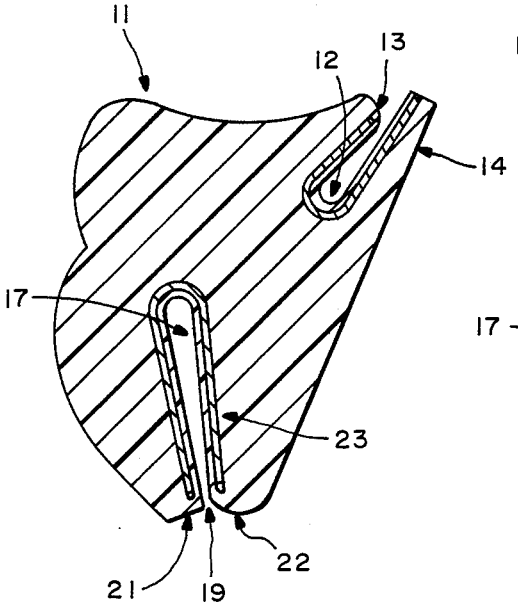
FIG. 2 is a sectional view of the mounting apparatus shown in FIG. 1.
Figure 3:
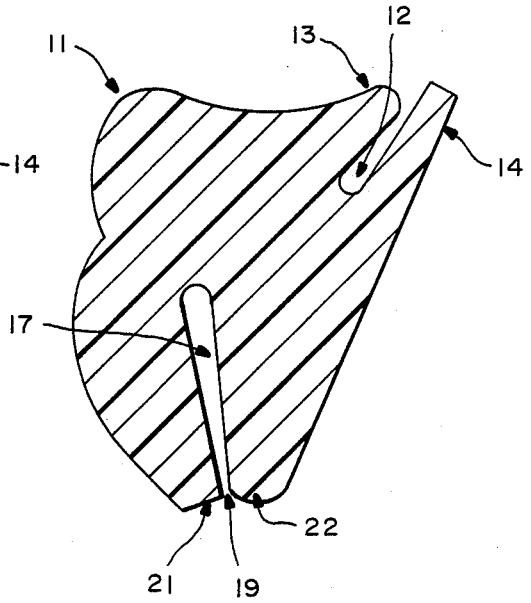
FIG. 3 is a sectional view of another embodiment of the mounting apparatus shown in FIG. 1.

Referring to FIGS. 1–2, the mounting apparatus includes a body 11 which is preferably made of a pliant material. The material may be shaped in the form of a design structure such as a nose, human or animal, for decorative effect. It is apparent that there are a number of other decorative shapes that can be formed, such as geometric designs. The top of the body 11 is provided with an eyeglass retaining slot 12 formed by two fingers 13 and 14. The slot 12 is adapted to receive and hold the bridge of eyeglasses. The outside end of the slot 12 is open with the fingers 13 and 14 extending toward one another. Depending on the chosen material of construction, an optional U-shaped spring or clamp 16 may be embedded in the pliant material to provide additional retaining or clamping force. The bridge of eyeglasses may be forced through the slot. The eyeglasses cannot be removed unless force is applied to spread the fingers. Given this characteristic, the eyeglasses remain secure regardless of the position of the mounting apparatus. FIGS. 2 and 3 show embodiments with and without clamping spring 16.

The apparatus also includes a jaw 17 which is adapted to secure the mounting apparatus 11 to any thin object, such as a car visor 18. The jaw opening 19 may or may not be closed, depending upon the type of object to which the mounting apparatus will be attached. Jaw members 21 and 22 may be reinforced by an embedded C-shaped spring or clamp 23 to further urge the fingers together, further insuring a secure attachment to objects, regardless of the position of the apparatus. FIGS. 2 and 3 show embodiments with and without clamping spring 23. The pliant body 11 is preferably formed from a material which is soft and compliant relative to plastic eyeglass materials to resist scratching eyeglasses. A preferable material is foam. Preferably, the apparatus is molded in a single piece construction. Manufactured in this way, the body is relatively inexpensive to produce.

In FIG. 1, the mounting apparatus is shown attached to a thin object 18 via the jaw opening 19. Eyeglasses 26 are placed within the eyeglass retainer slot 12, which securely holds the bridge of the eyeglasses. In addition to being supported at the bridge, the eyeglasses are supported as they rest upon the mounting apparatus. As the nose is formed from a compliant material, the frames, or if rimless glasses, the lenses, are not scratched even though they are in direct contact with the nose. The support from the eyeglass retainer slot 12 and the shape of the body is sufficient to hold the glasses securely in an upright position. The arms of the eyeglasses 27 may be extended or collapsed.

The object 18 to which the apparatus is secured may be a car visor. In such case, the mounting apparatus would be in a convenient location for the driver who could remove the eyeglasses from the eyeglass retainer slot 12 with his hand, while the mounting apparatus 11 would remain securely attached to the object 18. Regardless of its position relative to gravity, the mounting apparatus 11 and the glasses 26 will remain in a secure position under vibration and other forces which would tend to dislodge the glasses.

Figure 4:
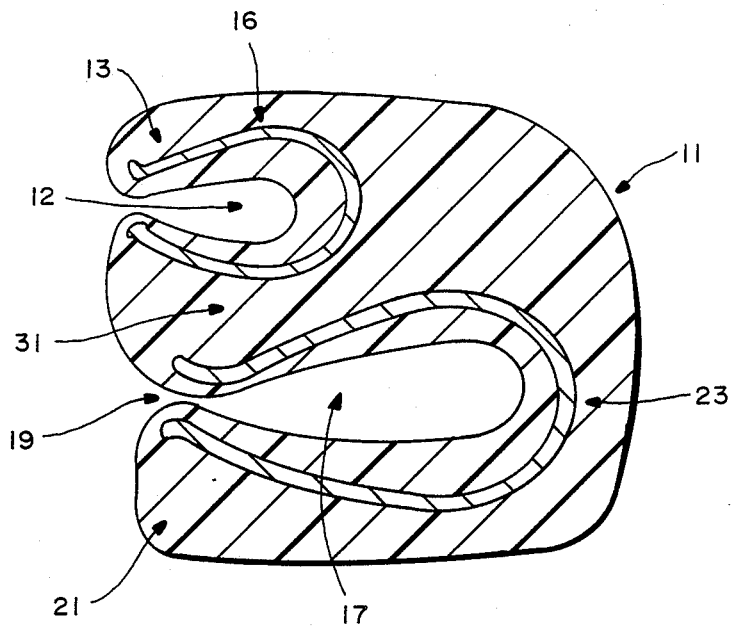
FIG. 4 is a sectional view of another embodiment of the mounting apparatus.
Figure 5:
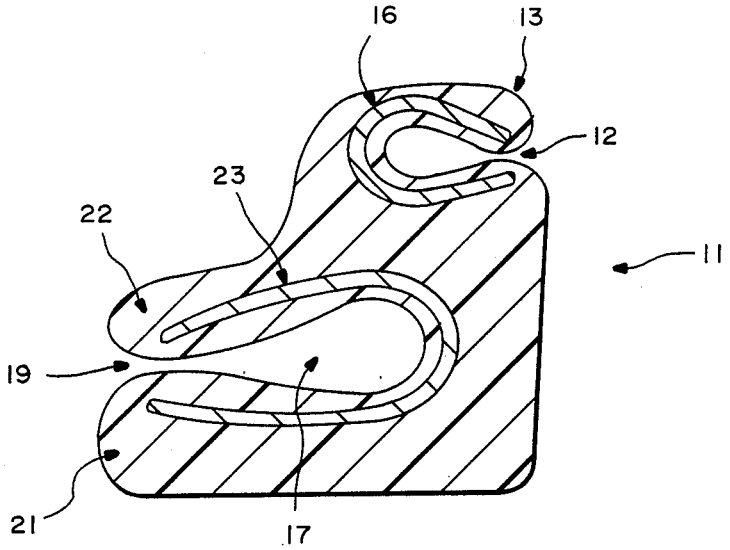
FIG. 5 is a sectional view of a further embodiment of the mounting apparatus.

FIG. 4 shows a mounting apparatus in which the slot 12 and jaws 17 extend in the same direction. The central portion 31 acts as an abutment with which the finger 13 and law member 21 cooperate. FIG. 5 shows a mounting apparatus in which the slot 12 and jaw 17 extend in opposite directions. Thus, there has been provided, in accordance with this invention, a decorative eyeglass mounting apparatus that fully satisfies the objects, aims, and advantages set forth above.

What is claimed is:

1. Apparatus for mounting eyeglasses to an object comprising:

a shaped body including a slot defined by at least one composite resilient finger, said composite resilient finger including U-shaped spring means embedded within said body and said finger and surrounding said slot to resiliently bias said finger to a position closely proximate said body for receiving and holding eyeglass bridges of different sizes, and said composite resilient finger and said body defining said slot being formed of a material which is soft and compliant relative to plastic eyeglass materials to resist scratching eyeglasses; and a jaw formed in the lower portion of said body, said jaw providing means to secure the body to an object to support eyeglasses whose bridge is placed in the slot on the object.

2. An apparatus as in claim 1 wherein said slot is defined by two composite resilient fingers which extend toward one another.

3. An apparatus as in claim 1 wherein the jaw comprises a pair of jaw members extending toward one another and a C-shaped clamp means is embedded within the body to provide additional clamping force.

4. An apparatus as in claim 1 wherein the body extends forwardly and is configured in the shape of a nose.

5. An apparatus as in claim 1 wherein a design structure is imposed between said slot and said jaw, said design structure being oriented in a normally forward position.

* * * * *